US005294301A

United States Patent [19]

Kumar et al.

[11] Patent Number: 5,294,301

[45] Date of Patent: Mar. 15, 1994

[54] PROCESS FOR MANUFACTURE OF PAPER

[75] Inventors: Velayudhan N. G. Kumar, Bombay, India; Patrick G. Jobe, West Fields, N.J.

[73] Assignee: National Starch and Chemical Investment Holding Corporation, Wilmington, Del.

[21] Appl. No.: 889,861

[22] Filed: May 28, 1992

[30] Foreign Application Priority Data

May 30, 1991 [GB] United Kingdom ..... 9111628

[51] Int. Cl.[5] ..... D21H 17/28

[52] U.S. Cl. ..... 162/168.1; 162/175; 162/183

[58] Field of Search ..... 162/175, 168.1, 183, 162/164.1

[56] References Cited

U.S. PATENT DOCUMENTS

| | | | |
|---|---|---|---|
| 3,785,921 | 1/1974 | Ide et al. | 162/175 |
| 4,604,163 | 8/1986 | Van Eeenam | 162/175 |

FOREIGN PATENT DOCUMENTS

| | | |
|---|---|---|
| 194987 | 9/1986 | European Pat. Off. . |
| 115/BOM/91 | 4/1991 | India . |
| 30-42200 | 1/1955 | Japan . |
| 62-104998 | 1/1987 | Japan . |
| 63-275795 | 3/1988 | Japan . |
| 63-219696 | 7/1988 | Japan . |

*Primary Examiner*—Peter Chin

*Attorney, Agent, or Firm*—Ellen T. Dec

[57] ABSTRACT

A process for the manufacture of paper from pulp employs at least one graft copolymer of starch selected from the group consisting of starch graft-polymethacrylic acid, starch graft-polyacrylic acid, cationic starch graft-polymethacrylic acid and cationic starch graft-polyacrylic acid as a wet-end additive. The graft copolymer preferably has an add on amount of acid of from about 0.1 to about 50% based on the weight of the starch, and is typically added to cellulosic pulp in an amount of from about 0.1 to about 10% based on the weight of the pulp. Such wet-end additives are also useful in processes involving relatively high alum levels of up to about 15 or 25%, based on the weight of the pulp.

9 Claims, No Drawings

PROCESS FOR MANUFACTURE OF PAPER

FIELD OF INVENTION

This invention relates to a process for the manufacture of paper. The invention finds particular use in relation to assisting manufacture of paper with wet-end additives.

BACKGROUND TO THE INVENTION

In paper making, cellulosic pulp is prepared by mechanical treatment in beaters which increases the surface area of fibers in the pulp by cutting, fibrillation and hydration. Subsequently, a dilute suspension of the pulp along with other materials (like alum, resin and fillers) is filtered on a wire screen. Water drains off through the wire screen and a wet fibrous mat retained on the wire screen is mechanically processed and dried. "Wet-end" additives are added as dispersions in water at a suitable stage to the pulp slurry prior to sheet formation.

In paper manufacture, starch derivatives may be used as wet-end additives to improve the processability (drainage and retention) and strength properties of paper. Cationic and amphoteric starches are, thus, widely used in the paper industry. Graft copolymers of starch with cationic monomers like dialklamino-alkyl(meth)acrylamide (JP 88,219,696, JP 87,104,998), dimethylaminopropyl acrylamide (JP 88,275,795) and 2-(methacryloyloxy) ethyltrimethylammonium Me sulfate (1986 Eur. Pat. Appl. EP 194,987) along with acrylamide (in most cases) have recently been reported as improving (when used as a wet-end additive) the drainage and/or retention during paper manufacture and/or dry strength properties of In the process of paper manufacture, whilst we do not wish to be bound by theory, we believe, the "mileage" obtained by use of wet-end additives results from improving fiber to fiber or/and fiber to filler bonding by anchoring onto reactive sites on the fiber and/or filler.

Interfiber hydrogen bonds are formed as a result of a wet paper web drying in the absence of any additive. The cationic starch based wet-end additives are known to anchor through their cationic functional groups onto the anionic reactive sites on cellulosic fibers (cellulose fibers in water are negatively charged due to ionised groups and residual lignin present on the surface of the fibers). Thus, the combination of natural fiber-fiber interaction through hydrogen bonding and the interfiber and fiber-filling bonding through anchoring of cationic polymers helps to improve drainage, retention and strength properties in paper manufacture.

However, the improvement in processing and properties brought about by these additives is influenced by (i) presence of other cationic species in the paper furnish, and (ii) the reactivity of the fibers and fillers for the cationic additives. There exist chemicals like aluminium sulphate (alum) giving rise to cationic species in water which are used extensively in paper-making, their primary role being to set rosin size. Alum is also known to have an impact on retention, drainage, paper strength and in addition it effects the pH and total system ionic charges.

The amount of alum used in paper making depends on the conditions optimised by a particular paper manufacturing unit. It is based on various considerations, such as, quality of pulp, water and type of fillers, etc. Alum is known to effect the performance of cationic and/or amphoteric starch based wet-end additives. Aluminium sulphate in solution gives rise to $Al^{+++}$, $Al(OH)_2^{+}$, $Al(OH)^{++}$ and $Al_8(OH)_{20}^{+4}$ species depending on the pH. These cationic species suppress the anionic charges on the fiber or filler and therefore reduce their reactivity to the cationic/amphoteric wet-end additives. Thus, although lower levels of alum are useful for rosin sizing and neutralising the anionic colloidal impurities in the furnish, higher levels of alum present in the furnish is detrimental to the performance of cationic and/or amphoteric wet-end additives.

A given paper making system can only tolerate a particular amount of combined cationic additives to deliver optimum performance as regards processing and properties of the finished product. The higher the concentration of alum used, the lower will be the performance of these polymers as wet-end additives and their use is restricted in such cases. Although alum as well as cationic polymers produce cationic species, their roles are different and many cationic polymers do not function fully in the presence of high amounts of alum. Thus, paper manufacturing processes are restricted to certain usage levels of alum/cationic polymers.

K. Tanaka, F. Masuda and K. Mita in a Japanese Patent JPB 55-42200 describes the synthesis of graft copolymers of starch and a carboxyl group - containing ethylenic unsaturated monomer, (sodium salt) and their use in strengthening of paper. The graft copolymers were synthesised from gelatinised starch. In more detail, 50 parts starch in gelatinised form is reacted with 50 parts of a carboxylated ethylenic monomer, with a synthetic monomer content of 10% to 1000% (by weight of starch) using hydrogen peroxide as catalyst. The product is neutralised with sodium hydroxide at the end of the reaction.

Treatment of paper pulp with 0.5% of this polymer is shown to improve the dry breaking length of paper at low alum levels of 0.5%, based on the weight of the pulp. The advantages described by the authors for the additive are (1) water solubility as compared to many starch derivatives used as paper additives, and (2) improved performance in improving some of the paper properties. The extent of property improvements described in this patent are also known to be achieved by commercially available cationic and amphoteric starch derivatives with the same levels of incorporation. However, the products exemplified can be expected to be costly owing to the fact that their synthesis involves the large amounts of synthetic monomers, to the difficult processing conditions associated with use of viscous starch dispersions, etc. and recovery of the product by energy intensive unit operations like drum drying.

There are no definite property attributes indicated in the aforementioned document for these additives vis-a-vis existing high performance wet-end additives under specific paper manufacturing conditions. Comparisons have been made with low performance dry strength improvement additives.

We have now surprisingly found an alternative process for making paper which may improve drainage and retention during processing and also improve the dry strength of paper. Process performance may improve with increasing amounts of alum up to a limit (about 10%) and further increases in the alum levels do not detrimentally affect the performance. Thus, the present process is also surprisingly effective for paper mills operating at high alum levels in addition to mills operating at moderate alum levels. This is in contrast to the case of some processes using cationic and/or amphoteric starch derivatives where performance is detrimentally affected due to presence of high amounts of alum.

DEFINITION OF THE INVENTION

Accordingly, the present invention provides a process for manufacture of paper involving use of one or more graft copolymers of starch selected from the group consisting of starch graft-polymethacrylic acid, starch graft-polyacrylic acid cationic starch graft-polymethacrylic acid, and cationic starch graft-polyacrylic acid as a wet-end additive.

The additives are preferably employed as dispersions at levels of from about 0.1 to about 10% (by weight of pulp) and added to cellulosic pulp along with other usual additives used for paper manufacture. Any additive may be used alone, or in combination with cationic or amphoteric starch derivatives (which are usually used as wet-end additives). The combination may be used as a pre-blend or by way of sequential incorporation into the furnish before it is processed on wire screen in paper manufacture.

Preferably the starch graft-polymethacrylic acid, starch graft-polyacrylic acid, cationic starch graft-polymethacrylic acid or cationic starch graft-polyacrylic acid used as a wet-end additive has a polymethacrylic or polyacrylic acid content of about 0.1 to about 50%, preferably about 0.1 to about 20%, more preferably about 0.1 to about 5% by weight of starch. The specified graft copolymers of starch are preferably added to as dispersions in water into cellulosic pulp, along with other usual additives used for paper manufacture either as such or in combination with other cationic or amphoteric starch derivatives, either as a preblend or by sequential incorporation into the furnish before it is processed on wire screen in paper manufacture.

The present process for manufacture of paper may involve use of alum in an amount up to about 25% preferably up to about 15% by weight of pulp. It is an advantage that the present wet-end additives may be employed effectively with relatively high levels of alum, for example typically about 2 to 10% by weight of alum, based on pulp weight.

The process and property improvements obtained in the process with alum usage levels of about 1 to 4% improve with higher usage of alum up to a maximum at about 10% and further incorporation of alum does not detrimentally affect the performance of the additives.

A suitable combination of starch-graft-polymethacrylic acid, starch graft-polyacrylic acid, cationic starch graft-polymethacrylic acid or cationic starch graft-polyacrylic acid and other commercially available cationic and/or amphoteric starch in ratios of from 1:100 or 100:1, or more preferably between about 0.1:1 to about 10:1, for example gives rise to retention, drainage and strength improvements when used as a wet-end additive at levels of about 0.1 to about 10% based on wet weight of pulp.

Sequential addition of a dispersion of starch graft-polymethacrylic acid or starch graft-polyacrylic acid or cationic starch graft-polymethacrylic acid or cationic starch graft-polyacrylic acid and any other cationic or amphoteric starches in ratios of about 0.1 to 10 into a paper furnish improves the strength, retention and drainage properties in paper manufacture even at low alum usage levels.

Embodiments of the present process for manufacture of paper may advantageously involve use of starch graft-co-polymers with features, such as, (i) they are preferably synthesised by simple processes involving reactions of granular starch as a slurry in water (unlike gelatinised starch described in prior art JP-B 55,42200) which involves difficult processing conditions such as handling viscous starch gels, and recovery of the product by energy intensive unit operations like drum drying, (ii) which preferably are incorporated at any stage during paper manufacture by dispersing in water by heating, (iii) show superior performance as compared to commercially available wet-end additives for paper, like cationic and amphoteric starches under specific paper manufacturing conditions such as use of high alum, (iv) the per cent add-on of the synthetic polymers like polymethacrylic acid and polyacrylic acid can be as low as 2% or even less (as compared to 10 to 1000% [by weight of starch] required for the additive reported in prior art JP-B 55 42200) for superior performance to commercially available cationic and amphoteric starches as wet-end additives, (v) show improvement in breaking length and tear factor which were also claimed in prior art JP-B-42200 and in addition the present invention provides improvements in dry strength properties like burst, wax pick, double fold, etc. and (vi) shows improvement in processability of paper manufacture by improving drainage, etc.

The starch graft-copolymers which are thus found suitable are starch graft-polymethacrylic acid, starch graft-polyacrylic acid, cationic starch graft-polymethacrylic acid and cationic starch graft-polyacrylic acid. These when used as additives in levels of about 0.1 to 10% (based on weight of pulp) in paper manufacture (in conditions using alum in levels up to about 25% preferably up to about 15% by weight of pulp) improves the drainage and retention in processing of paper and dry strength properties of finished paper.

The starch derivatives mentioned herein can be described as follows:

Novel wet-end additives used in accordance with the invention

1. Starch graft-polymethacrylic acid: Graft-copolymer of starch and methacylic acid prepared by reacting methacrylic acid with granular starch as a slurry in water using a redox polymerisation reaction. In the present examples the starch graft-polymethacrylic acid was prepared in accordance with the procedure described in Indian Patent Application No. 115/BOM/91. This comprises treating starch with a redox initiator such as ascorbic acid, thereafter reacting starch with methacrylic acid in an aqueous medium and in the presence of an oxidising agent such as hydrogen peroxide. The methacrylic acid or a hydrotope, such as urea, is brought into contact with the starch substantially before the starch comes into contact with the oxidising agent.
2. Starch graft-polyacrylic acid: Same as (1), with acrylic acid used in place of methacrylic acid.
3. Cationic starch graft-polymethacrylic acid: Prepared by graft-copolymerising methacrylic acid on cationic starch or reacting cationic reagents like quaternary amines with starch graft-polymethacrylic acid. Preferably the starch derivatives are prepared from a reaction involving a slurry of granular starch, reacted without gelatinisation.

4. Cationic starch graft-polyacrylic acid: Same as above where acrylic acid is used in place of methacrylic acid or starch graft-polyacrylic acid is used in place of starch graft-polymethacrylic acid.

Known materials used for comparison

5. Cationic starches: Commercially available cationic starch derivatives usually produced by reacting starch with reagents containing amino, imino or ammonium groups.
6. Amphoteric starches: Commercially available amphoteric starches usually produced by reacting cationic starches (described above) with phosphates like sodium tripolyphosphate.

The improved process of paper manufacture will now be illustrated by way of examples. The examples are by way of illustration and do not restrict the scope of the invention.

Example 1

Furnish containing beaten pulp blends (comprising 70% Eucalyptus and 30% Bamboo) with 1.2% rosin, 6% alum and 15% soap stone (filler) was processed with or without 1% dispersion of additive. The additives were incorporated before alum incorporation and handsheets (circular with dia 16.5 cm and basis weight of 60 g/m$^2$) were made on British sheet making machine using back water circulation at pH 4.5. The handsheets were tested for various properties. The properties are given below:

| Additive used | Drainage (secs.) | Burst Factor | Breaking Length (mts.) | Double Fold | Tear Factor | Wax Pick |
|---|---|---|---|---|---|---|
| Nil | 7.33 | 32 | 5275 | 15 | 37 | 7A |
| A (1%) | 6.24 | 43 | 6550 | 40 | 44 | 13A |
| B (1%) | 6.74 | 41 | 6235 | 40 | 43 | 14A |

Where, A is starch-graft-polymethacrylic acid prepared in the laboratory from a reaction of methacylic acid with granular starch in water slurry with 4.2% add-on of polymethacrylic acid and B is Cato 3210, an amphoteric starch marketed by National Starch & Chemical Corporation, USA. In one of the experiments, no additive was used. The methods of analysis used for the tests described in the example were as per international organisation for standardisation procedures. The procedure for analysis are listed below.

Burst factor-ISO 2758, Broaking length-ISO 1924, Double fold-ISO-DIS-5626, Tear factor-ISO-1974, Wax pick-Tappi method.

This example indicates significant improvement in the drainage and strength properties by use of A as a wet-end additive in the process of paper manufacture. The improvements in drainage and strength properties except double fold and wax pick are better than B and in case of double fold and wax pick the properties are comparable to those obtained with B.

Example 2

The procedure was the same as followed for the above experiment. The additive used was a 1:1 blend of cationic starch (0.3% N) and starch-g-polymethacrylic acid (S-g-PMAA, 4.2% polymethacrylic acid add-on). The properties of the handsheet are given below.

| Additive used | Drainage (secs.) | Burst Factor | Breaking Length (mts.) | Double Fold | Tear Factor | Wax Pick |
|---|---|---|---|---|---|---|
| Nil | 7.33 | 32 | 5275 | 15 | 37 | 7A |
| C | 6.06 | 39 | 6495 | 21 | 45 | 12A |

Additive C is an 1:1 blend of starch graft-polymethacrylic acid (4.2% add-on of polymethacrylic acid) and cationic starch (0.3% nitrogen).

Overall improvement in drainage and strength properties is indicated by use of a blend of cationic starch and starch-graft-polymethacrylic acid. This illustrates the utility of starch graft-polymethacrylic acid as a material which can be used along with a conventional additive such as a cationic starch for improved benefits.

Example 3

The improvement in drainage by addition of Starch-graft-polymethacrylic acid during processing of paper pulp was studied by adding a dispersion of the starch derivative to paper pulp and measuring the drainage rate.

| | |
|---|---|
| Pulp: | 500 CSF unbleached Kraft |
| Alum: | 3.3% (by weight on weight of pulp) |
| pH: | 5.5 |

The results are as follows:

| Additive | Drainage ml/sec | % of Blank | % Additive (by wt. on wt. of pulp) |
|---|---|---|---|
| Nil | 43.7 | 100 | 1 |
| D | 70.6 | 160 | 1 |
| E | 84.5 | 193.4 | 1 |
| F | 72.3 | 165.4 | 1 |
| D | 94.9 | 217.2 | 2 |
| E | 94.9 | 217.2 | 2 |
| F | 87.9 | 201.1 | 2 |

D = Starch-graft-polymethacrylic acid with polymethacrylic acid (PMAA) add-on of 4.06%.
E = Starch-graft-polymethacrylic acid with PMAA add-on 1.87%.
F = Starch-graft-polymethacrylic acid with PMAA add-on 0.86%.

The results show significant improvement in drainage when starch-graft-polymethacrylic acid samples were added at 1% level which improved further when the additives were incorporated at 2% level.

Example 4

The improvement in drainage by addition of starch-graft-polymethacrylic acid and cationic starch graft polymethacrylic acid samples was also studied by freeness studies conducted using a Schopper-Riegler freeness tester. The higher the freeness, the better the drainage property. The results given below indicate that starch-graft-polymethacrylic acid and cationic starch graft polymethacrylic acid improve the drainage properties of paper pulp at various alum usage levels. The improvements are comparable to and in some cases better than commercially available additive like Cato 302 and Cato 3210.

| Freeness measurement of E-C-B-H pulp | |
|---|---|
| Additive used (1% on pulp wt.) | Freeness (ml) |
| 3% alum usage level | |

-continued

| Freeness measurement of E-C-B-H pulp | |
|---|---|
| Additive used (1% on pulp wt.) | Freeness (ml) |
| Nil | 740 |
| D | 755 |
| G | 740 |
| H | 770 |
| I | 750 |
| J | 770 |
| K | 775 |
| 6% alum usage level | |
| Nil | 745 |
| D | 760 |
| G | 735 |
| H | 775 |
| I | 745 |
| J | 780 |
| K | 770 |
| 10% alum usage level | |
| Nil | 740 |
| D | 760 |
| G | 740 |
| H | 800 |
| I | 745 |
| K | 770 |
| L | 780 |

E-C-B-H pulp = Eucalyptus (47%), Casurine (44%), Bamboo (4%), Hard wood (5%) mixed pulp.
D = Starch graft polymethacrylic acid with polymethacrylic acid add-on of 4.06%
G = Cato 302
H = Cato 3210
I = Starch graft polymethacrylic acid with polymethacrylic acid add-on of 0.8%.
J = Cationic starch graft polymethacrylic acid with % N = 0.099 and PMAA add-on of 0.82%.
K = Cationic starch graft polymethacrylic acid with % N = 0.294 and PMAA add-on of 0.77%.
L = Cationic starch graft polymethacrylic acid with % N = 0.131 and PMAA add-on = 1.03%.

Example 5

Adsorption of Starch-g-Polymethacrylic acid and cationic starch graft-polymethacrylic acid on pulp at various alum levels Adsorption of the wet-end additive on pulp is an indication of its ability to introduce fiber-fiber bonding and thereby have an effect on drainage, retention and strength properties during paper manufacture. The detrimental effect of high usage levels of alum on performance of commercially available wet-end additives like cationic and amphoteric starches is also characterised by the lower adsorption of these additives onto pulp from a solution in water when alum levels are increased in solution. The following experiment demonstrates the utility of the starch derivatives described in the invention by comparing the adsorption of starch graft-polymethacrylic acid on paper pulp as compared to cationic starch when various levels of alum are present in solution.

A dispersion of the starch derivatives in solution is added to a suspension of the beaten pulp in water containing different amounts of alum. 5% by weight of the starch derivatives by weight of pulp (on dry basis) is thus added to pulp suspension containing alum at different levels and the pH of the solutions were adjusted to either 4.5 or 5 as is specified below along with the results. Cato 302, a commercially available cationic starch wet-end additive, was used in this experiment to demonstrate the difference in adsorption behaviour.

Adsorption of Cato 302 and starch-graft-polymethacrylic acid on paper pulp were carried out under the following conditions:

| | |
|---|---|
| pH: | 4.5 or 5 as indicated |
| Pulp: | Beaten mill pulp without any additive of the following composition |
| Mixed Hardwood: | 4.7% |
| Bamboo: | 4.1% |
| Eucalyptus: | 46.8% |
| Casurina: | 44.4% |
| Amount of Additive added: | 5% based on weight of pulp added as a dispersion water. |

The results of the adsorption studies are as follows:

| | % of additive adsorbed after 45 mins | | |
|---|---|---|---|
| Alum | | Starch-graft copolymer | |
| (% wt. on pulp) | Cato 302 | (Sample D) | (Sample K) |
| pH = 4.5 | | | |
| 4 | 84.7 | 88.7 | 93 |
| 6 | 81.4 | 100 | 100 |
| 10 | 73.4 | 100 | 100 |
| pH = 5 | | | |
| 6 | 76 | 100 | |

D = starch graft polymethacrylic acid with PMAA add-on of 4.06%.
K = cationic starch graft polymethacrylic acid with % N = 0.294 and PMAA add-on = 0.77%.

The additive is introduced into an alum solution containing a suspension of pulp after adjusting the pH to the desired level. The amount of additive left unadsorbed in solution was estimated after 45 minutes using colorimetric methods. Color for starch derivatives were developed using iodine complexation and calibrations were made independently for each the starch derivative.

The results show that the adsorption of cationic starch decreases with increasing alum levels and that of starch-g-polymethacylic acid increases with increasing alum levels. The overall adsorption of starch-g-polymethacrylic acid is higher than that of Cato 302. (Cato 302 is a commercial cationic starch marketed by National Starch & Chemical Corporation, USA).

The improved process of paper manufacture using novel additives therefore show significant improvement over the earlier processes known.

We claim:

1. In a process for the manufacture of paper from an aqueous pulp furnish, the improvement comprising adding to the aqueous pulp furnish at least about 0.1% based on the weight of the pulp, of at least one graft copolymer of starch selected from the group consisting of starch graft-polymethacrylic acid, starch graft-polyacrylic acid, cationic starch graft-polymethacrylic acid and cationic starch graft-polyacrylic acid, wherein said graft copolymer has an add-on amount of polymethacrylic or polyacrylic acid of from 0.1 to 5% by weight of starch.

2. A process according to claim 1 wherein the said at least one graft copolymer of starch is starch graft polymethacrylic acid.

3. A process according to claim 1 wherein the said at least one graft copolymer of starch is employed in an amount of from about 0.1 to about 10% based on the weight of the pulp.

4. A process according to claim 3 wherein the said at least one graft copolymer of starch is employed in an amount of from about 0.25 to about 5% based on the weight of the pulp.

5. A process according to claim 1 further comprising addition of alum to the pulp in an amount of up to about 25% based on the weight of the pulp.

6. A process according to claim 5 further comprising addition of alum to the pulp in an amount of up to about 15% based on the weight of the pulp.

7. A process according to claim 5 in which the said at least one graft copolymer of starch is added to said pulp substantially prior to the addition of alum to said pulp.

8. A process according to claim 5 in which the alum is added to the pulp substantially prior to the addition to to the pulp of said at least one graft copolymer of starch.

9. A process according to claim 1 in which two of said graft copolymers of starch in combination are added to the aqueous pulp furnish, said combination comprising the said two graft copolymers of starch in a ratio of between about 1:10 and about 10:1.

* * * * *